United States Patent [19]

Beele

[11] Patent Number: 4,690,385

[45] Date of Patent: Sep. 1, 1987

[54] METHOD FOR STORING AND MAINTAINING THE TEMPERATURE OF MOLTEN METAL

[75] Inventor: Günther Beele, Kerpen-Blatzheim, Fed. Rep. of Germany

[73] Assignee: Kloeckner-Humboldt-Deutz AG, Cologne, Fed. Rep. of Germany

[21] Appl. No.: 915,779

[22] Filed: Oct. 6, 1986

Related U.S. Application Data

[62] Division of Ser. No. 836,095, Mar. 4, 1986, Pat. No. 4,638,980.

[30] Foreign Application Priority Data

Mar. 5, 1985 [DE] Fed. Rep. of Germany ..... 3507648

[51] Int. Cl.[4] ..... C21C 7/02

[52] U.S. Cl. ..... 266/44; 75/53; 75/58; 266/216; 420/20

[58] Field of Search ..... 266/216, 44; 75/53, 75/58; 420/20

[56] References Cited

U.S. PATENT DOCUMENTS 3,295,960 1/1967 Parlee ..... 266/216

*Primary Examiner*—Peter D. Rosenberg

*Attorney, Agent, or Firm*—Charles L. Schwab

[57] ABSTRACT

An apparatus (1) for storing and maintaining the temperature level of molten metals, such as a cast iron melt which has been treated with pure magnesium. The apparatus includes a heatable furnace chamber (3) having a pressure-tight cover (4) and an inlet and an outlet (2), which also may be provided with a cover (6). The inlet and outlet (2) is preferably formed as a common inlet and outlet siphon. The closed furnace chamber (3) is supplied with a medium such as argon or nitrogen under pressure. A cast iron melt which has been treated with particular additives can be maintained at a certain temperature over longer periods of time with a decaying effect.

4 Claims, 1 Drawing Figure

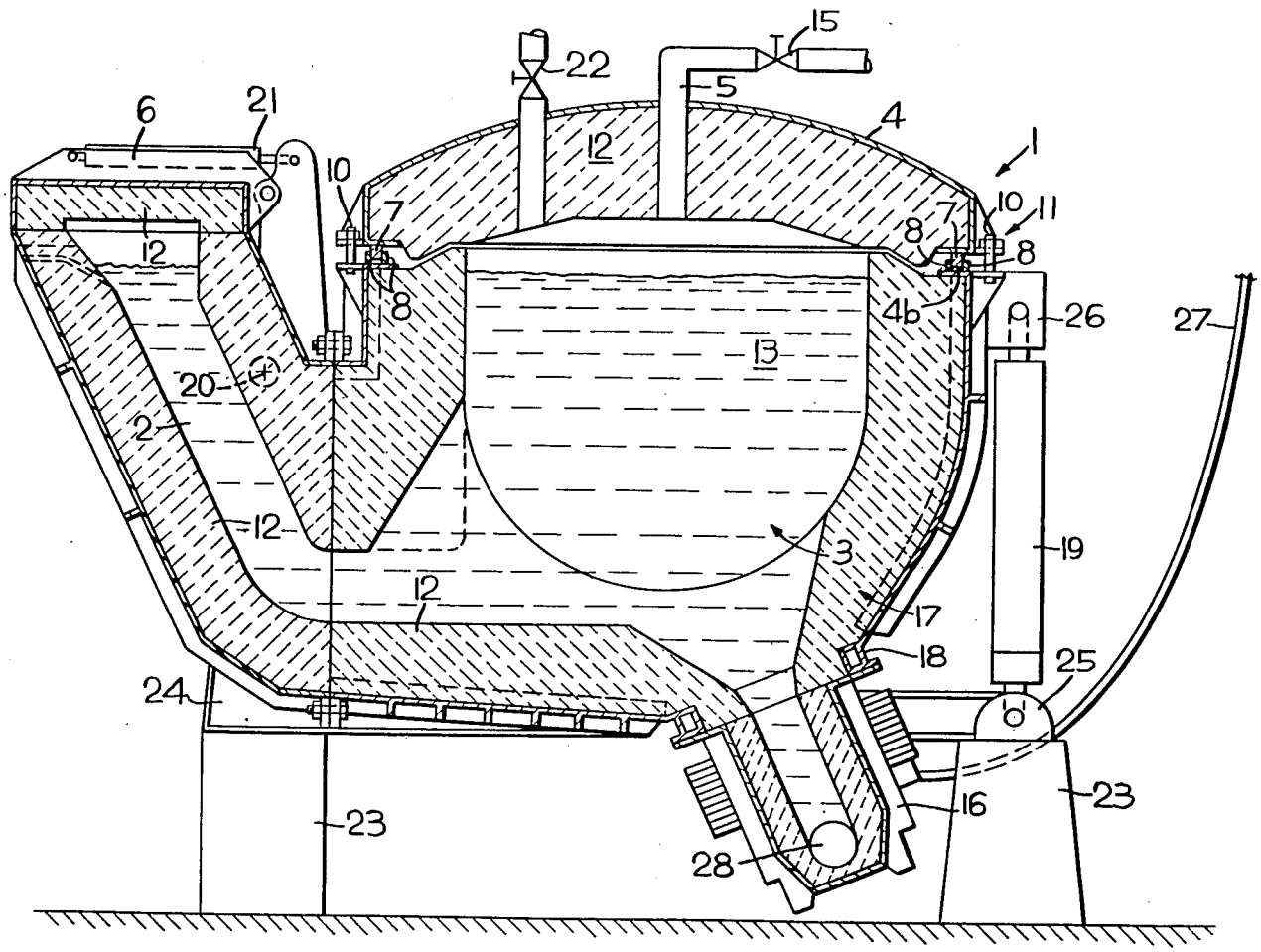
1
2
3
4
4b
5
6
7
8
9
10
11
12
13
15
16
17
18
19
20
21
22
23
24
25
26
27
28

METHOD FOR STORING AND MAINTAINING THE TEMPERATURE OF MOLTEN METAL

This is a division of application Ser. No. 836,095, now U.S. Pat. No. 4,638,980, filed Mar. 4, 1986.

TECHNICAL FIELD OF THE INVENTION

This invention relates to a method of maintaining the temperature of a nodular or vermicular cast iron melt which has been treated with magnesium, and with pure magnesium in particular, in a heatable furnace chamber which is sealed with a cover.

BACKGROUND, OBJECTS AND SUMMARY OF THE INVENTION

In foundry operations and within the field of metallurgy in general, the need to heat great quantities of molten metal, or to maintain the temperature level of quantities of molten metal over a long period of time, often arises since the entire quantity of the melt is not needed immediately after having been melted. There are known designs of smelting and/or temperature-maintenance furnaces for heating or maintaining the temperature of a cast iron melt, as for example, submerged channel induction furnaces and crucible induction furnaces.

These commercial smelting and/or temperature maintenance furnaces cannot be used for maintaining the temperature of liquid molten metals which have previously been treated with particular additives. This is due, in particular, to the fact that the material added escapes from the molten metal during the course of temperature maintenance, which results in so-called decaying of the melt. An example of this would be the cast iron with globular graphite which is currently being produced in increasing quantities using magnesium, and particularly pure magnesium, as an additive. The procedure of treating molten cast iron with pure magnesium to produce nodular cast iron has taken on increasing significance because it is possible by the immersion converter process to add the magnesium to the initial iron melt accurately and extremely economically. Heretofore, however, it has been necessary to pour the liquid molten metal immediately following a magnesium treatment in order to avoid the before-mentioned decaying effect. This, however, is contrary to economic operation of a foundry, since it is extremely desirable to be able to store the molten metal at a desired pouring temperature, after an immersion treatment has been completed, for long periods of time so that treated molten metal with the same characteristics could be available for pouring as the need for it arose.

It is, therefore, the aim of this invention to provide an improved apparatus and a method of use to satisfy the outlined objectives in the easiest possible way whereby molten metal can be stored and its temperature maintained without decay after it has been treated with particular additives such as, for example, nodular cast iron which has been treated with pure magnesium.

In order to meet this and other objectives, the apparatus for storing and/or increasing or maintaining the temperature level of molten metals includes a furnace chamber provided with a pressure-tight cover and an inlet for a pressurized medium. With such an apparatus, a nodular cast iron melt which has been treated with magnesium, and with pure magnesium in particular, can be kept heated to the desired casting temperature for an almost unlimited time. A decrease in the magnesium content or decaying of the nodular cast iron is virtually eliminated. The process herein described meets the objective of providing an economical process of treating a large quantity of an initial iron melt with the respective additives and maintaining its temperature thereafter in a temperature maintenance furnace from which molten metal can be removed in amounts occasionally necessary for casting. It is believed economically practical to modify various known temperature maintenance furnaces, such as the submerged channel induction furnace, so that they, as modified, can be used to carry out the process of this invention.

The inlet and outlet means of the apparatus, in the preferred embodiment of the invention, are provided by a common inlet/outlet siphon, which can also be sealed pressure-tight by using a closing cover in a manner similar to the way in which the furnace chamber is closed. A cover for the siphon may not be necessary for some uses to which the apparatus is put, since only a small loss of magnesium occurs when using an uncovered combined inlet and outlet siphon. Where the highest possible quality is required, the use of a cover on the siphon is recommended.

The pressure-tight sealing of the furnace chamber cover can be accomplished by means of a sealing strip. The sealing strip can be located on the cover of the furnace chamber for sealing contact with the top rim of the furnace chamber. Similarly, a sealing strip may be placed on the closing cover for the siphon in sealing relation to the pouring end of the common inlet and outlet siphon. The sealing strip locks into a sealing channel provided on the confronting walls of the furance chamber or, as the case may be, on the siphon. The sealing strip preferably has a T-shaped cross-sectional profile.

Apparatus carrying out this invention preferably includes a pressure relief valve for the furnace chamber which releases pressure in the chamber through use of known electrical control systems. The cover preferably remains locked until the pressure within the furnace chamber returns to normal atmospheric pressure. A medium under pressure is delivered by way of a supply opening or inlet to the furnace chamber, which can be accomplished using known electrical systems, after a secure pressure-tight sealing of the furnace chamber has been accomplished. Depending on the requirements for use, it may be desirable to provide a second pressure relief valve.

The apparatus is preferably designed as a tiltable electrical induction furnace whereby the inductor is arranged on the lower section of the furnace chamber as perpendicular as possible beneath the furnace. This perpendicular arrangement beneath the furnace is advantageous particularly in that it reduces unwanted slag suspension deposits.

In this invention, the use of an inert gas under pressure is preferred for the medium, and nitrogen and argon have proven most successful. Depending on the output values (for example, magnesium content) desired for the molten metal which is being kept hot, the inert gas with a pressure level of up to six times atmospheric pressure is delivered to the inside of the furnace. The pressure load of the furnace chamber is, in the case of nodular cast iron melt which has been treated with pure magnesium, regulated in such a way that the level of disintegration of the magnesium which is in the melt is kept at approximately zero.

BRIEF DESCRIPTION OF THE DRAWING

The attached drawing shows a section of a furnace chamber and attachments for the purpose of illustrating one embodiment of the invention.

DETAILED DESCRIPTION OF THE DRAWING

The apparatus for maintaining the temperature of a nodular cast iron melt which has been treated with pure magnesium is indicated by the number 1. This apparatus includes a furnace chamber 3 having a main part 5 to which is secured an outlet means in the form of a common inlet and outlet siphon 2. The furnace chamber 3 is supported on a foundation 23 and a furnace support 24, and can be pivoted about a horizontal pivot axis 20 by means of an extensible actuator or cylinder 19. The opposite ends of the actuator 19 are connected, respectively, to a lower supporting bearing 25 and an upper supporting bearing 26. The furnace chamber 3 can be closed pressure-tight by a chamber cover 4. The sealing means **4*b* on the cover 4 of furnace chamber 3 presents a T-shaped sealing strip 7, which locks into an upwardly open sealing channel or groove 8 on the rim of the furnace chamber 3. The confronting areas of the furnace chamber 3 and the cover 4, as well as the design of the sealing strips 7 and the sealing channel 8, are designed so that after the furnace chamber 3 has been sealed by the cover 4, an added layer of fireproof material (such as corundum) increases the seal tightness of the furnace chamber and protects the seal. The cover 4 is sealed pressure-tight with furnace chamber 3 by a closing arrangement 11 including a keyed closing pin 10. The design of the sealing of the pivotable lid or cover 6 for the common inlet and outlet siphon 2 can be similar to the pressure-tight sealing of the furnace chamber 3** just described. For purposes of simplification, this has not been illustrated in the drawing.

The furnace chamber 3 as well as the common inlet/-outlet siphon 2 are lined on the inside with a fireproof material 12, as also are the furnace chamber cover 4 and the closing cover 6. This fireproof material is designed along the upper areas of furnace chamber 3 and the lower areas of cover 4 in such a way that the sealing surfaces of cover 4 are effectively shielded in respect to the inside of the furnace 13.

An inlet 5 is provided in the cover 4 of the furnace chamber 3 for supplying a pressurized medium such as argon or nitrogen. Also, a pressure relief valve 15 for furnace chamber 3 is mounted on the cover 4. The electrical control and switching system for the inert gas supply 5, the closing arrangement 11, and the pressure relief valve 15 is not shown in detail. The inductor 16 is located almost perpendicularly under the furnace chamber to provide heat for furnace chamber 3. The inductor 16 is connected to a source of electrical energy by an electric line 27 and is surrounded on the furnace chamber side by cooling flange 18. The inductor 16 is supplied molten metal by way of an induction channel 28 which is constantly connected with the interior 13 of the furnace chamber 3. The illustrated construction of the inductor 16 contributes to the described elimination of slag suspension deposits. The inductor 16 has a flanged connection with the furnace chamber 3, however, it may be attached to the chamber 3 in any suitable manner.

The method of this invention for storing and maintaining anodular cast iron melt includes the steps of providing a heatable furnace with an inner chamber adapted to receive a cast iron melt, at least partially filling the chamber with a nodular cast iron melt which has been treated with magnesium, closing the chamber with a sealed pressure-tight cover, maintaining the temperature of said melt within a predetermined range of casting temperature values, and filling the space in the inner chamber above the melt with an inert gas and pressurizing same to an extent sufficient to prevent decay of the melt (disintegration of the magensium in the melt).

The embodiments of the invention in which an exclusive property or privilege is claimed are defined as follows:

1. A method of storing and maintaining the temperature of a nodular cast iron melt comprising:

providing a heatable furnace having an inner chamber adapted to receive a cast iron melt, at least partially filling said inner chamber with a nodular castiron melt which has been treated with magnesium, maintaining the temperature of said melt within a predetermined range of casting temperature values, closing said furnace chamber with a sealed pressure-tight cover, and filling the space in said inner chamber above said melt with an inert gas and pressurizing said gas to an extent sufficient to prevent disintegration of the magnesium in said melt.

2. The process of claim 1 wherein said melt has 0.03 to 0.07 percent magnesium content by weight.

3. The process of claim 1 wherein said inert gas is nitrogen.

4. The process of claim 1 wherein said inert gas is argon.

* * * * *